US008100402B2

(12) United States Patent
Salomon et al.

(10) Patent No.: US 8,100,402 B2
(45) Date of Patent: Jan. 24, 2012

(54) COLLECTABLE TRADING CARD GAME

(76) Inventors: Emanuel Salomon, Plantation, FL (US); Anthony Marino, Miami, FL (US)

( * ) Notice: Subject to any disclaimer, the term of this patent is extended or adjusted under 35 U.S.C. 154(b) by 0 days.

(21) Appl. No.: 12/212,154

(22) Filed: Sep. 17, 2008

(65) Prior Publication Data

US 2009/0072483 A1 Mar. 19, 2009

Related U.S. Application Data

(60) Provisional application No. 60/994,094, filed on Sep. 17, 2007.

(51) Int. Cl.
*A63F 9/00* (2006.01)

(52) U.S. Cl. ..... 273/236; 273/240; 273/161; 273/155; 273/153 R; 273/138.1

(58) Field of Classification Search ..... 273/236, 273/161, 155, 138.1, 153 R, 240
See application file for complete search history.

(56) References Cited

U.S. PATENT DOCUMENTS 502,896 A 8/1893 Vine
4,042,246 A * 8/1977 Strandgard ..... 273/245
4,083,563 A 4/1978 Drohomirecky et al.
5,662,332 A 9/1997 Garfield
5,843,262 A 12/1998 Rosendale et al.
6,315,632 B1 11/2001 Gibbons et al.

* cited by examiner

*Primary Examiner* — Benjamin Layno
(74) *Attorney, Agent, or Firm* — Mark D. Bowen, Esq.; Malin Haley DiMaggio Bowen & Lhota, P.A.

(57) ABSTRACT

A collectable card game of strategy and skill that includes a plurality of collectable cards, each of which preferably comprise a character-specific collectable card. Each collectable card corresponds to a character and contains character specific information regarding the character, including attributes and capabilities of the character such as offensive and defensive characteristics and assigned values. Each collectable card is adaptable from a generally flat configuration to a folded configuration generally in the form of a "fortune teller" novelty piece that functions during play as a functional game piece. Once each player has configured his collectable card into the game piece configuration, the players engage in a battle that consists of a series of rounds. During each round, the players engage in a series of alternating offensive strikes and mitigating defensive plays, the combined net score of which is then deducted from a predetermined "life force" value assigned with each character card. The game concludes after a predetermined number of rounds or when the life force values of all but one surviving character/player are reduced to zero.

2 Claims, 8 Drawing Sheets

COLLECTABLE TRADING CARD GAME

CROSS REFERENCE TO RELATED APPLICATIONS

This application claims the benefit of provisional U.S. Patent Application Ser. No. 60/994,094, filed on Sep. 17, 2007.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to games that combine chance and strategy, and, more particularly, to such a game wherein collectable trading cards are used in a folded configuration to provide individual hand-held playing pieces used in a game of strategy.

2. Description of Related Art

Trading cards, collectables, and games are all well known. A trading card (or collectible card) is a small card that is intended for trading and collecting. Some trading cards are used in game play. Collectable trading cards originally as premiums distributed with tobacco products, but became very popular as inserts to bubblegum packs. Eventually, the cards became the more desirable content, and the gum, with few exceptions, is no longer included in trading card packs.

Trading cards are traditionally associated with sports; baseball cards are especially well-known. Cards dealing with other subjects are often considered a separate category from sports cards, known as editorial trading cards or simply non-sports trading cards. These often feature cartoons, comic book characters, television series, or movie stills.

As with collectable cards, which they generally resemble, trading cards may sometimes be used to play various games. In the 1990s, cards designed specifically for playing games became popular enough to develop into a distinct category of collectible card games. These tend to use either fantasy subjects or sports as the basis for gameplay.

Accordingly, the prior art reveals the following contributions to the art of collectable card games. A typical example of a collectable trading card game incorporating elements of strategy and chance is found in U.S. Pat. No. 5,662,332, issued to Garfield. Garfield discloses a trading card game and method of play. In one version, the game components comprise energy cards, and command or spell cards having commands or spells associated therewith that utilize the energy to enable a player to attack, defend and modify the effect of other energy cards, spell cards. The goal of the game is to reduce the life points of other players to a level below one. In this game of strategy and chance, players construct their own library of cards, preferably from trading cards, and play their library or deck of cards against the deck of cards of an opposing player. Cards may be obtained from retail outlets, trading with other players or collectors, and winning cards at games and tournaments.

Other games found in the art utilize folded paper devices, familiar to many, and identified generally as "fortune teller" novelty devices. A "fortune teller", also alternatively known as a "cootie catcher" is an origami device used in fortune-telling games by children. There are two positions that the device can be held, generally forming either an opening elongate along a first axis or an opening elongate along a second axis generally perpendicular to the first axis switching positions is used to mean opening it into the other position. U.S. Pat. No. 502,896, issued to Vine, discloses a device used for amusement and advertising, produced as a simple and cheap device. The device consists of a piece of paper, adapted to be folded into the familiar "fortune teller" shape. Suitable designs are printed in independent sections in proper relation so as to fit together and present a desired appearance when in use.

In a similar manner, U.S. Pat. No. 4,803,563, issued to Drohomirecky et al., adapts a "fortune teller" novelty device as a game component, wherein first and second indicia means on inner flaps are provided, with the first indicia being viewable when the panels are positioned in one position, and the second indicia being viewable when the panels are positioned in another position.

U.S. Pat. No. 5,843,262, issued to Rosendale et al., discloses a multi-surface novelty piece and method for making same. The novelty piece generally comprises a "fortune teller" device fabricated from a single sheet of paper having printing on both sides.

U.S. Pat. No. 6,315,632, issued to Gibbons, discloses a fortune telling toy made to be held in the hands of a player for manipulation into specific positions. The toy is comprised of a body portion formed by folding and reinforcing a sheet of flexible material. The body is comprised of an inner surface and an outer surface. When folded and reinforced in the specified format, flexible outer flaps are integrally formed and allow the players fingers and thumb to slide under said flaps to manipulate the body portion between specific positions. The folding of the sheet also produces a plurality of flexible inner flaps that are integrally formed with the body portion and hingeably secured thereto and adapted to be disposed in a closed position in overlapping relationship with the body portion to an open position extending upwardly from the body portion, with each inner flap having a viewable outer surface marked with indicia and an inner surface. The inner flaps formed by the folding are sliced or divided so as to form a greater number of inner flaps. In the preferred embodiment, substantially translucent sheet material forms one or more card holder layers and is sewn or otherwise attached to the inner flap to form a pocket. Chance means or message cards are slid into the pocket between the card holder layer and the inner surface. When held in specific positions, a multiple of the inner flaps is revealed and the indicia marked on the viewable outer surface of said inner flaps is visible.

While these disclosures may be suitable for the particular purposes to which they are addressed, they fail to provide a collectable card game involving elements of strategy and chance played with the fortune teller novelty device.

BRIEF SUMMARY OF THE INVENTION

The present invention overcomes the limitations and disadvantages present in the art by providing a collectable card game of strategy and skill that includes a plurality of collectable trading cards, each of which preferably comprise a character-specific collectable card. The collectable trading card game may be adapted in various formats, including fantasy, non-fantasy, sports, and entertainment related formats. In a preferred embodiment, the present invention is adapted in a fantasy version. In the preferred embodiment, each collectable trading card corresponds to a character and contains character specific information regarding the character, including attributes and capabilities of the character such as offensive and defensive characteristics and assigned values. Each collectable trading card is adaptable from a generally flat configuration to a folded configuration generally in the form of a "fortune teller" novelty piece that functions during play as a functional game piece or game component. Once each player has configured his collectable trading card into the game piece configuration, the players engage in a battle that consists of a series of rounds. During each round, the players engage in a series of alternating offensive strikes and mitigating defensive plays, the combined net score of which is then deducted from a predetermined "life force" value assigned to the defender's character card. The respective scores are kept by a scoring system comprised of a "life force bar" incorporated directly on each collectable card. The life force bar comprises an area wherein the accumulation and loss of life force units is tracked using a dry erase marker. The game concludes after either: a predetermined number of rounds; time expiration; or when the life force values of all but one surviving character/player are reduced to zero.

Accordingly, it is an object of the present invention to provide an improved game of strategy.

Another object of the present invention is to provide a game of strategy utilizing "fortune teller" novelty playing pieces.

Still another object of the present invention it to provide a game of battle strategy and skill based on fictional characters having individual characteristics and capabilities.

In accordance with these and other objects, which will become apparent hereinafter, the instant invention will now be described with particular reference to the accompanying drawings.

DETAILED DESCRIPTION OF THE INVENTION

Figure 1:
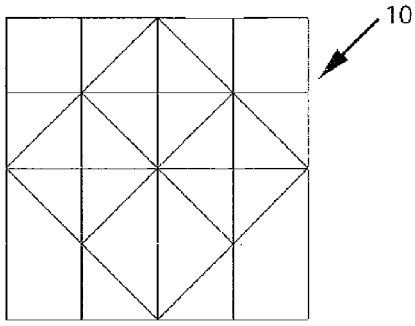
FIGS. 1-13 illustrate the steps required to transform a foldable sheet collectable trading card playing piece from a flat configuration to a folded configuration for use.
Figure 2:
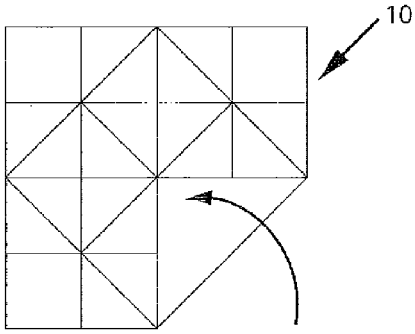
Figure 3:
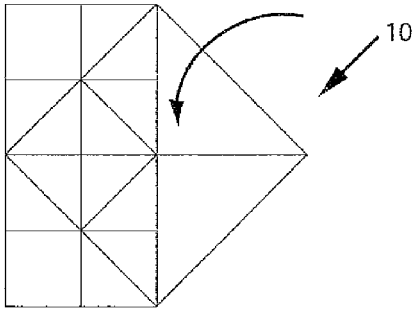
Figure 4:
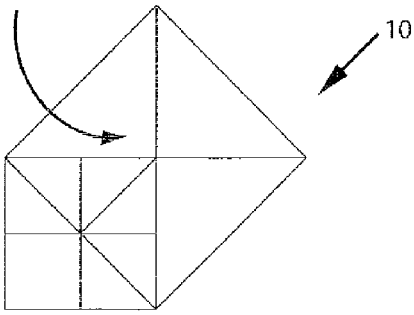
Figure 5:
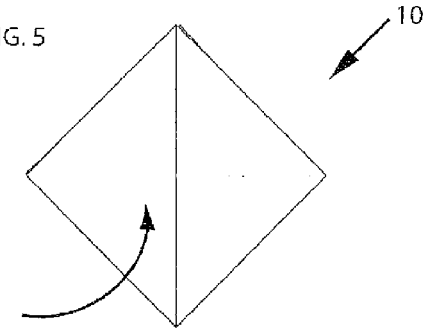

The present invention provides a game of strategy played using collectable character trading cards. In a preferred embodiment, trading cards are provided for a plurality of characters (referred to as OGGIES) are separated into two distinct races (e.g. OGGIEONS and OGORONS). In the preferred embodiment a total of 34 distinct characters and companion characters, or more, are contemplated, however, any suitable number is considered within the scope of the present invention. For entertainment purposes the two races (or classes) of characters are preferably generally characterized as peaceful and warmongering respectively. Each character race preferably consists of seventeen distinct characters having different skills and attributes, and embodied on a foldable trading card. Within each character race there exists a class structure that may include: (1) a leader; (2) conventional characters; and (3) one or more levels of companion characters. The primary characteristics associated with each character include (1) a numeric value for "life-force" corresponding to the characters ability to absorb punishment and/or damage inflicted by another character; (2) offensive strike capabilities and corresponding values for reducing an opposing player's life force; and (3) defensive capabilities for mitigating strikes from opposing players.

As noted above, the various characters are each embodied on separate collectable trading cards, with each trading card representing one of a number of "characters" for use in playing the game of strategy disclosed herein. In a preferred embodiment, a plurality of characters (referred to as OGGIES) are separated into two distinct races (e.g. OGGIEONS and OGORONS). Each character race consists of a plurality of distinct characters. In a preferred embodiment, each character race includes 17 characters comprising at least one "leader" and a plurality of "conventional" and "companion" characters. The leaders are generally considered the most intelligent, capable, and powerful characters, and thus a leader is most evenly matched when battling an opposing leader. The conventional characters are the most numerous characters and each character has its own attributes, strengths, and weaknesses. Companion characters are generally considered the least intellectual and weaker characters, and often are teamed with a conventional or leader character as a companion.

As noted above, the collectable cards are foldable from a generally flat configuration to a folded configuration generally in the form of a "fortune teller" novelty piece that functions during play as a functional game piece. Once each player has configured his collectable card into the game piece configuration, the players engage in a battle that consists of a series of rounds. During each round, the players engage in a series of alternating offensive strikes and mitigating defensive plays, the combined net score of which is then deducted from a predetermined "life-force" value assigned with each character card. Life-force values are tracked on the life force bar area on each card using a dry erase marker to add or subtract life force values. The game concludes after a predetermined number of rounds or when the life force values of all but one surviving character/player are reduced to zero.

Figure 6:
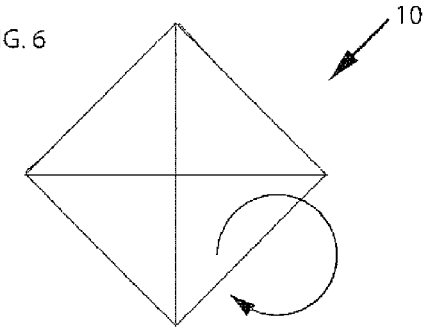
Figure 7:
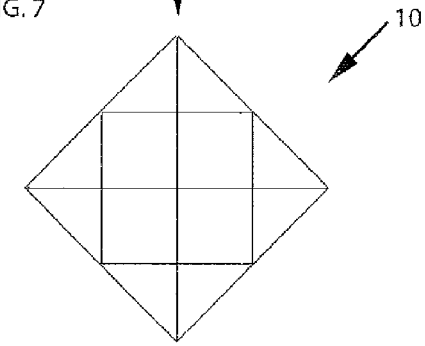
Figure 8:
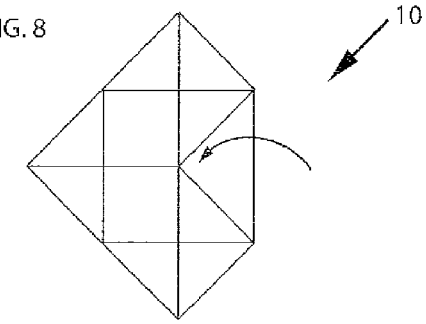
Figure 9:
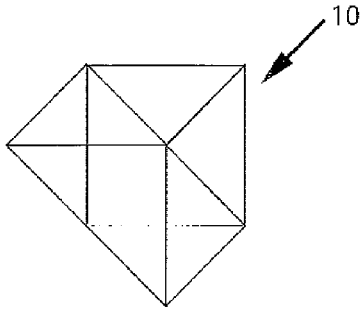
Figure 10:
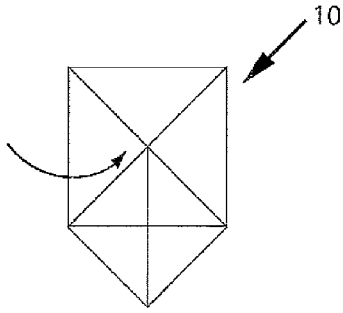
Figure 11:
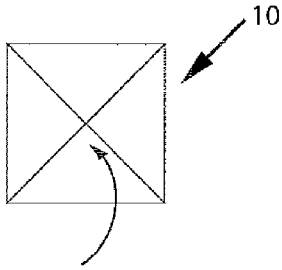
Figure 12:
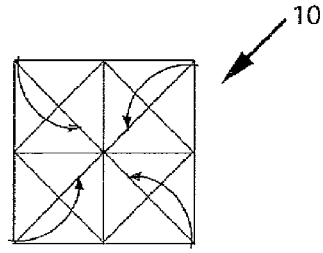
Figure 13:
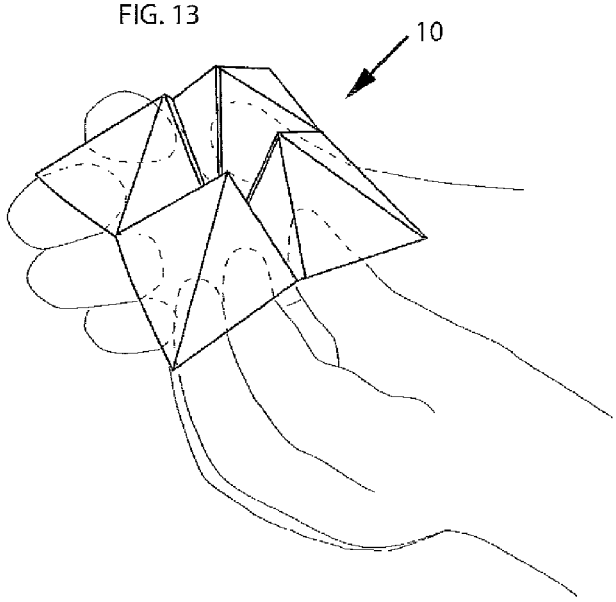

With reference now to the drawings, FIGS. 1-13 illustrate a collectable trading card, generally referenced as 10, configurable from a flat configuration as shown in FIG. 1 to a folded configuration for use in playing a game of strategy and skill in accordance with the present invention as best illustrated by FIG. 13. FIGS. 1-13 depict various folding steps that, when completed, transform the generally flat sheet like trading card 10 into a novelty device that may be manipulated to achieve random selections for use in playing a game of skill and strategy in accordance with the present invention. FIGS. 1-5 depict the first series of folds wherein collectable trading card 10 is manipulated by folding each outer corner to the center of the card to arrive at the configuration depicted in FIG. 5. FIGS. 6 and 7 illustrate flipping the card over. FIGS. 8-10 depict the second series of folds wherein collectable trading card 10 is manipulated by folding each outer corner to the center of the card to arrive at the configuration depicted in FIG. 11. Trading card 10 is then folded in half as illustrated in FIG. 12 such that the user is able to insert his fingers underneath the flaps as illustrated in FIG. 13.

Figure 14:
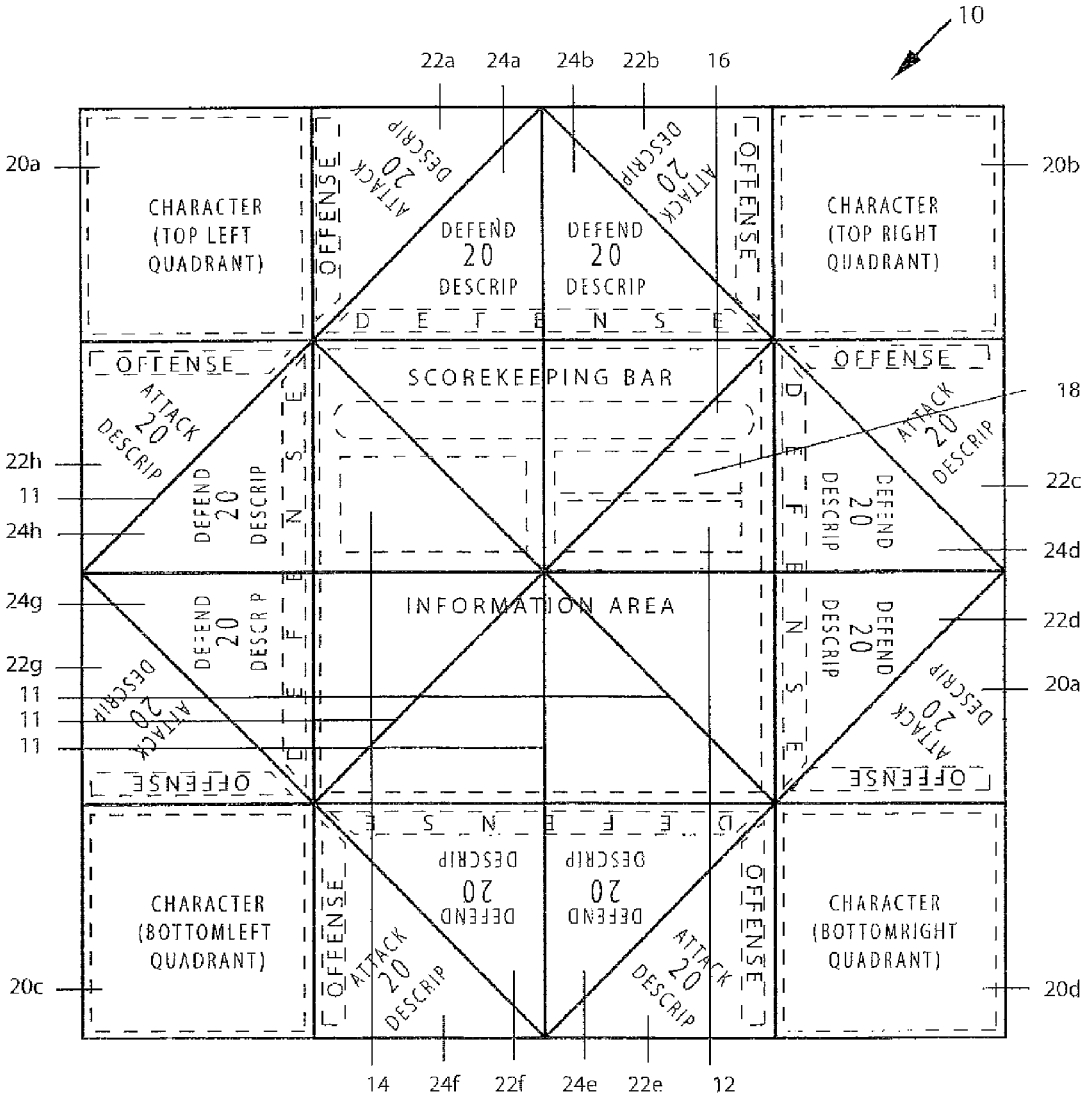
FIG. 14 depicts a first side of a playing piece in a flat configuration.
Figure 15:
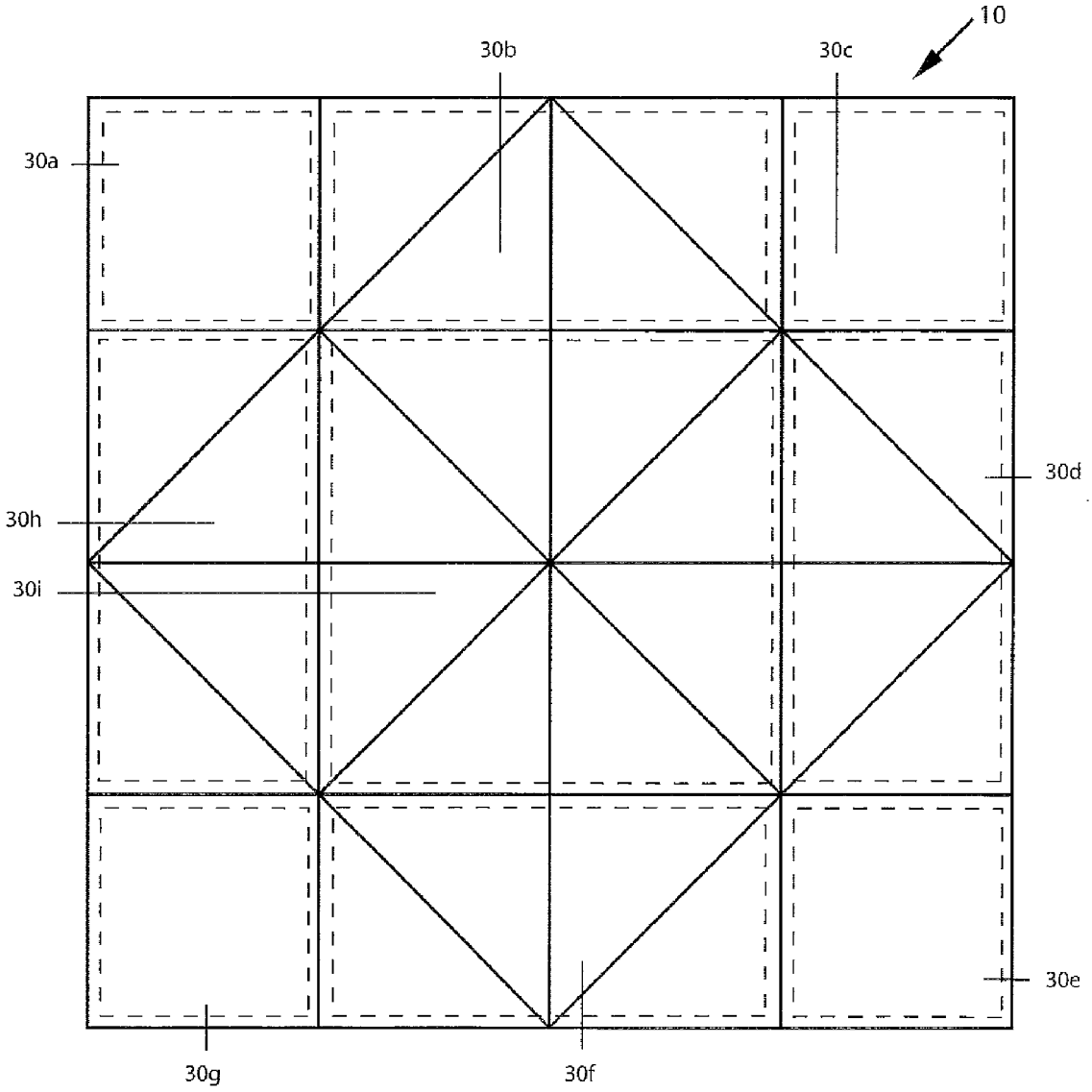
FIG. 15 depicts the second side thereof.

Turning now to FIGS. 14-18, there is depicted a schematic example of a collectable trading card 10 in accordance with the present invention. FIGS. 14 and 15 respectively depict first and second sides of collectable trading card 10. Collectable trading card 10 preferably comprises sheet-like material that may be adapted for folding with scored or creased fold lines generally referenced as 11. As best seen in FIG. 14, the first side of collectable trading card 10 is divided into a plurality of sections containing a variety of text and graphics. Among the information contained on the first side depicted in FIG. 14 is a space 12 reserved for indicia providing the identity of the character. The indicia in space 12 preferably consist of a number and name identifying the character (e.g. #9—SOLARA). In addition, the first side depicted in FIG. 14 includes a space, referenced as 14, containing a fanciful graphic representation of the character. A score keeping area, referenced as 16 is provided. In the preferred embodiment, score keeping area 16 comprises an elongate bar with markings from a minimum life force value (e.g. 0) to a maximum life-force value (e.g. 120). Score keeping bar 16 is preferably adapted with a surface for use with a dry erase marker to allow the user to track the character's life-force value during the game by adding or subtracting life-force points as more fully discussed herein below. The use of a dry erase surface and marking instrument allow for markings to be erased to enable trading card 10 to be used multiple times. Collectable trading card 10 further includes a life force value (e.g. 106), referenced as 18, assigned to that character.

Figure 19:
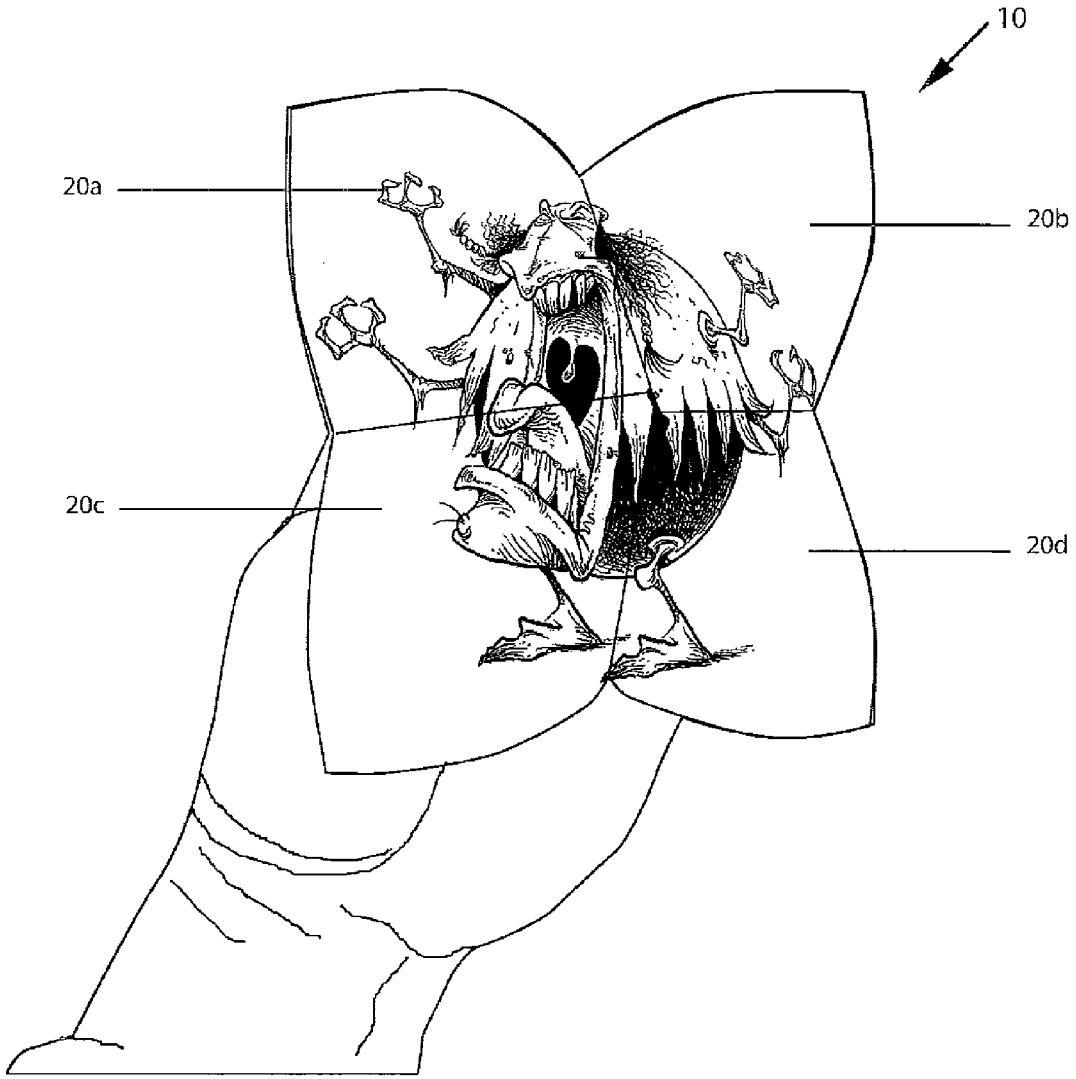
FIG. 19 illustrates the collectable trading card playing piece in the folded closed configuration wherein a character is depicted.

As best seen in FIG. 14, collectable trading card 10 includes a peripheral border that includes four generally square corner sections 20*a-d*, eight offensive triangular sections 22*a-h*, and eight defensive triangular sections 24*a-h*. Square corner sections 20*a-d* each include one-quarter of the graphic representation 14 of the character that combine to complete a graphic representation of the character when trading card 10 is fully folded and configured to the closed configuration best illustrated in FIG. 19. Offensive triangular sections 22*a-h* each contain a designated attack capability with an associated attack value. Defensive triangular sections 24*a-h* each contain a designated defense capability with an associated defense value. The following table provides an exemplary listing of the possible attack and defense capabilities for trading card 10.

| REF. | ATTACK | LIFE FORCE | REF. | DEFENSE | LIFE FORCE |
|---|---|---|---|---|---|
| 22a | Punch | 5 | 24a | Punch | 30 |
| 22b | Kick | 5 | 24b | Kick | 30 |
| 22c | Sun Burn | 40 | 24c | Ash Splash | 40 |
| 22d | Heat Rash | 40 | 24d | Lava Drain | 35 |
| 22e | Fire Breath | 40 | 24e | Sun Down | 40 |
| 22f | Melt Touch | 35 | 24f | Hot Block | 30 |
| 22g | Rings of Fire | 40 | 24g | Burning Factor | 40 |
| 22h | Power Rayz | 40 | 24h | Fire Fear | 40 |

The various attack capabilities are visible when the folded trading card is held facing the user and manipulated such that the mouth moves between horizontal and vertically opened configurations. More particularly, when trading card 10 (SOLARA) is folded, facing the user, with the mouth forming a generally horizontal opening, attack capabilities 22*a*, 22*b*, 22*e* and 22*f* are displayed in corresponding upper and lower left and right quadrants. Conversely, when trading card 10 is configured with the mouth forming a generally vertical opening, attack capabilities 22*c*, 22*d*, 22*g*, and 22*h*, are displayed in corresponding upper and lower left and right quadrants. In a similar manner, the various defense capabilities are visible by folding up the attack flaps. More particularly, when trading card 10 (SOLARA) is folded, facing the user, with the mouth forming a generally horizontal opening, defense capabilities 24*a* and 24*b* may be revealed by folding up the top flap. Accordingly, each of the various defense capabilities may be identified and viewed in the corresponding upper flap, lower flap, left flap, and right flap, with each flap revealing two defense capabilities. The attack and defense capabilities can be further randomized by rotating the trading card, such that the capabilities are shifted to different positions, prior to play.

Figure 16:
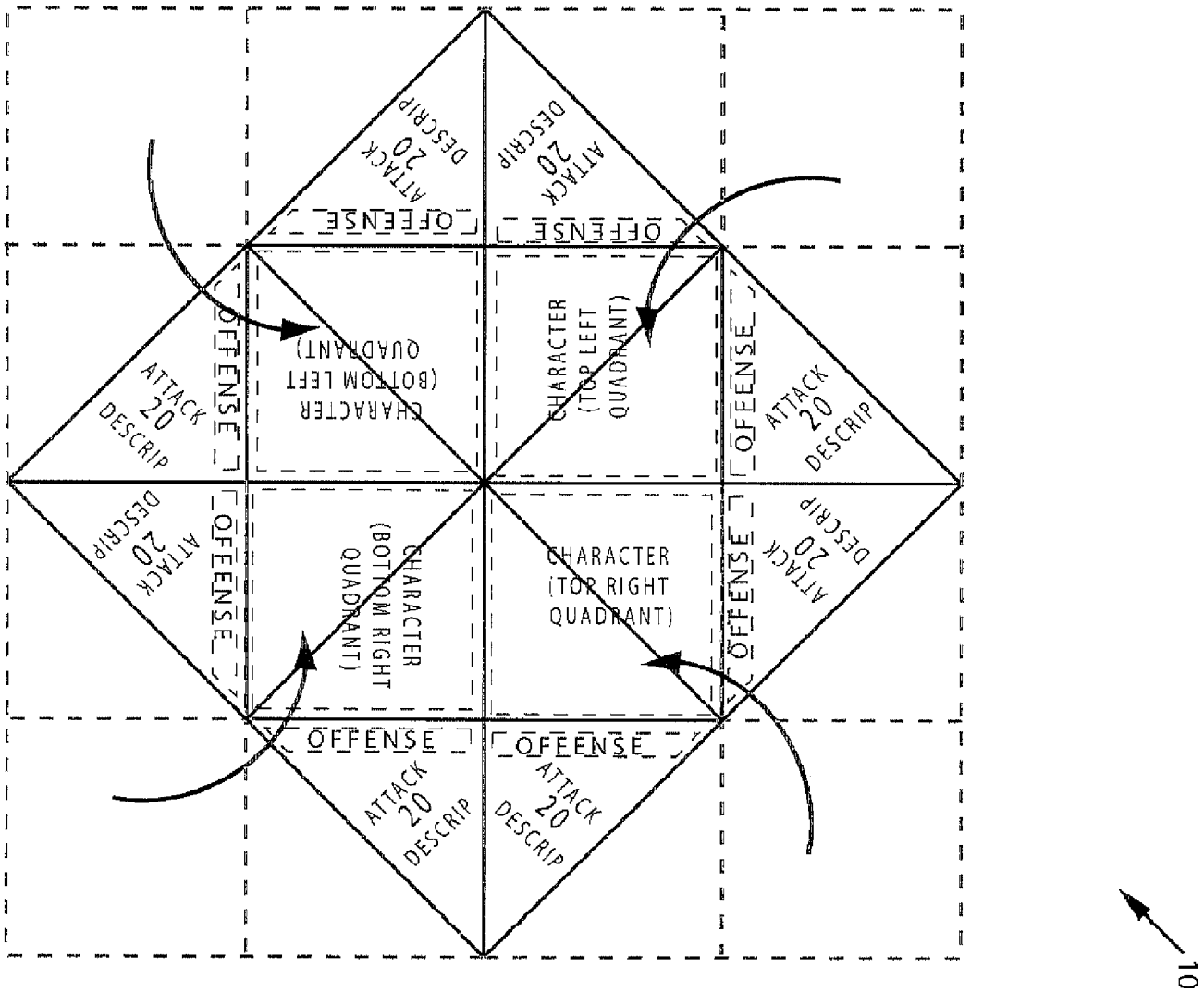
FIGS. 16 and 17 depict the respective sides of the playing piece after completion of the first folding steps.
Figure 17:
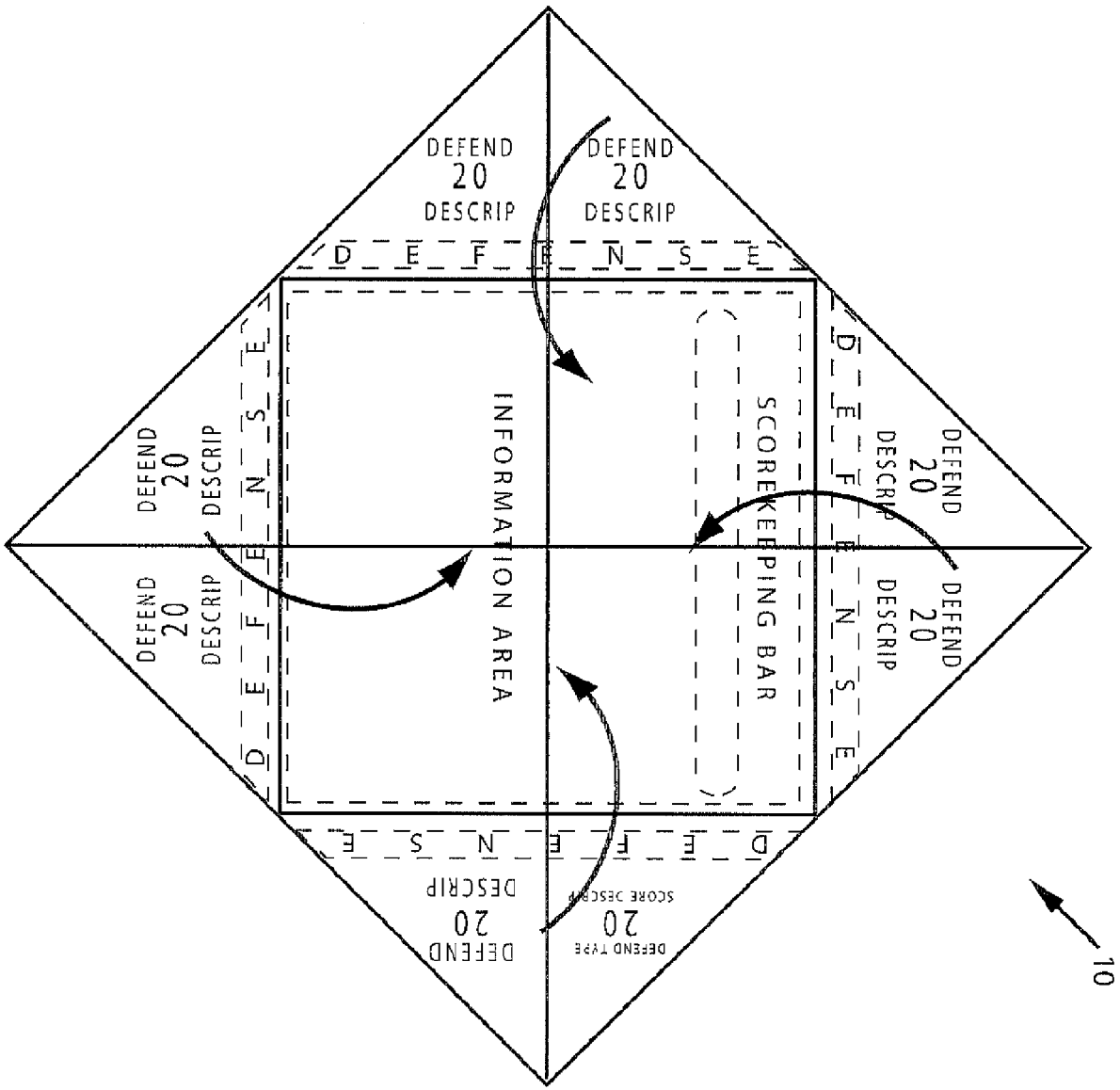
Figure 18:
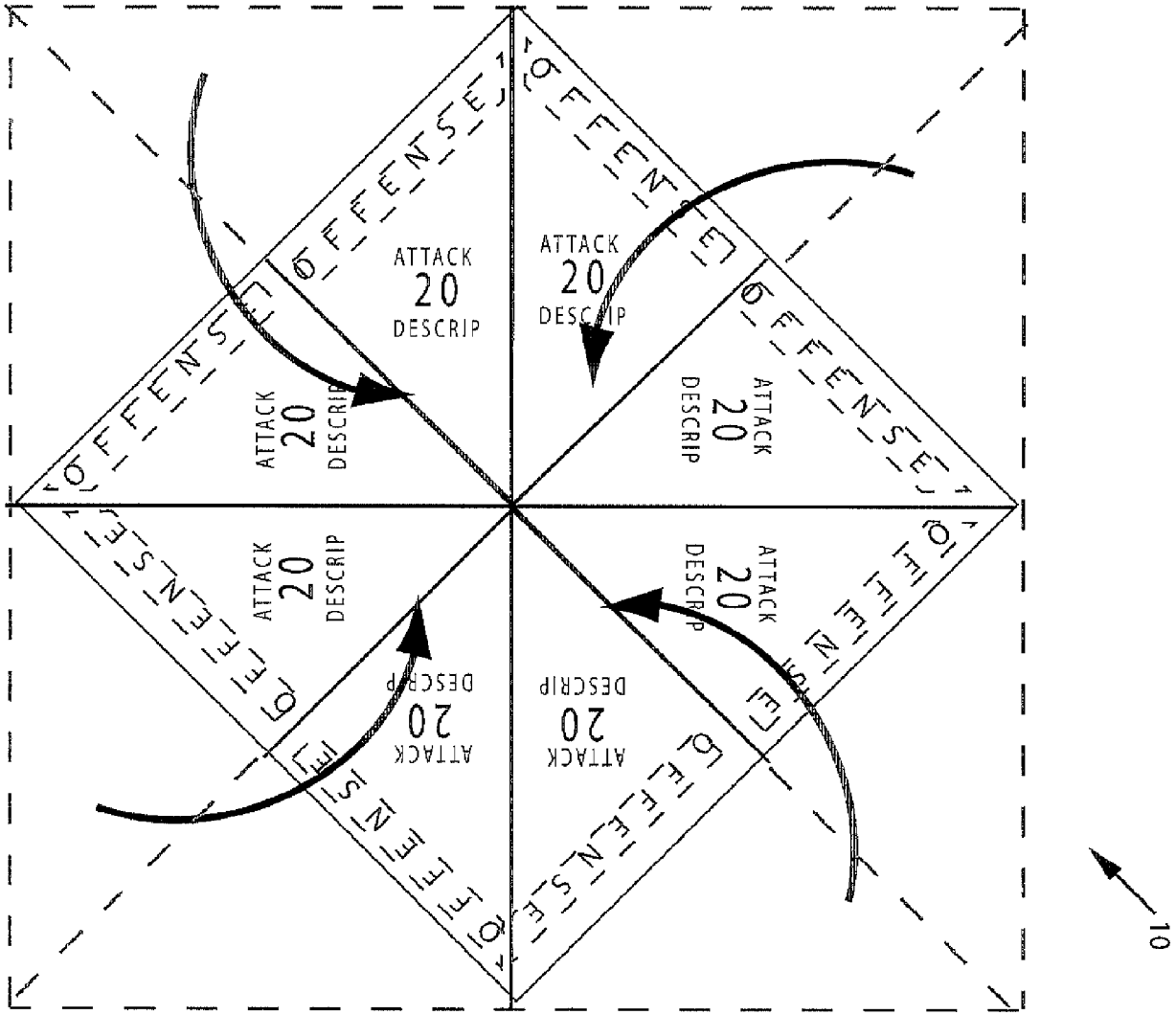
FIG. 18 depicts the attack side of the playing piece after completion of the final folding steps.

As best illustrated by FIG. 15, the opposite side of collectable trading card 10 is preferably divided into information areas and design areas, referenced as 30*a-i*. Each information and design area 30*a-i* may be populated with information, such as game rules, graphics, or any other suitable indicia. FIG. 16 illustrates the collectable trading card 10 as depicted in FIG. 14 in the folded configuration shown in FIG. 5. FIG. 17 illustrates the opposite side of the collectable trading card seen in FIG. 16. FIG. 18 depicts the collectable trading card seen in FIG. 17 with the corners folded over.

The following generally describes the rules followed by two players, each having a collectable card.

1. Two or more players agree to BATTLE (e.g. contest).
2. A battle duration is agreed upon by all players. For example, the players may agree to a set number of rounds, a set time period, or until one player's life-force reaches zero etc.
3. Each player selects one of their OGGIE trading cards and chooses the position in which to hold their OGGIE which is shown to all players. This position must be held for duration of one battle and may be changed for each battle.
4. The youngest OGGIE attacks first. Youngest being determined by the born on date which is found on back side of the folded OGGIE. If the born on date happens to be the same, the youngest player goes first.
5. The attacker player calls out a number from 1 to 5. Both players, at the same time, open and close their OGGIE in alternating horizontal open/closed/vertical/open/closed/horizontal switching moves (a process called the "O-Motion") as many times as the number called and ending in an open position.
6. The defender then calls one of the following: top left, top right, bottom left, bottom right. The attacking player does not let the defending player see his attack before the position is called. The attacker then looks at the corresponding flap of his OGGIE and shows the defender the attack number, the defender then opens the fold of the same called position and reveals the defense number.
7. The defense number is subtracted from the attack number and the result gets marked on the Life Force bar of the defender's OGGIE. If the defense number is more than the attack, the attacker must mark off the number in the life-force bar on his OGGIE.
8. Steps 5-7 are repeated and the defender now becomes the attacker, this process alternating until the agreed upon duration is reached or until one players' Life Force goes into the red zone on the Life Force Bar and the player is eliminated.
9. The player with the highest Life Force left is the winner.

As should now be apparent, the present invention combines colorful and fanciful collectable trading cards with a game of chance and strategy thereby providing countless hours of amusement and imaginative fin.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A game having game components for use by first and second players, said game comprising:

a plurality of generally square-shaped sheet-like game components, including first and second game components;

each game component being associated with one of a plurality of fictional characters;

each game component identifying a life force value corresponding to said one of a plurality of fictional characters;

each game component having a first side and a second side, said first side including a peripheral border that defines four generally square corner sections and four generally triangular sections disposed between each of said corner sections;

said four corner sections each including one quarter of a graphic image, said entire graphic image comprising the image of fictional character;

said four generally triangular sections including two offensive sections, each offensive section disposed adjacent to one of said corner sections, and two defensive sections, each defensive section disposed between said corner sections and said offensive sections;

each offensive section having indicia indicating a numerical attack value, each defensive section having indicia indicating a numerical defense value;

said numerical attack value and said numerical defense value for said game component being specific to the fictional character associated with said game component;

each game component further including a score keeping area;

each game component foldable to form an origami fortune-teller device configurable from a closed configuration to first and second open configurations, said device including inwardly projecting flaps with said offensive sections disposed on the top thereof and said defensive sections disposed on the bottom thereof, such that a first set of four numerical attack values are displayed in upper and lower left and right quadrants with said device configured in said first open configuration and a second set of four numerical attack values are displayed in upper and lower left and right quadrants with said device configured in said second open configuration, and numerical defense values disposed on the bottom of each flap;

said four corner sections being disposed in generally adjacent relation so as to complete said entire graphic image of said fictional character when said fortune-teller device is disposed in a closed configuration;

written instructions for informing the players how to use said first and second game components to engage in a contest with each player alternating turns as attacker and defender and scorekeeping in order to determine a winner.

2. A game according to claim 1, wherein said score keeping area includes a dry erase surface, and said a marking instrument that allows for marking for scoring purposes and erasure of said marking to allow for repeated use.

* * * * *